US008214963B2

(12) United States Patent
Yu

(10) Patent No.: US 8,214,963 B2
(45) Date of Patent: Jul. 10, 2012

(54) MOP WITH SPINNING DEVICE

(76) Inventor: Tsung Mou Yu, Taipei (TW)

( * ) Notice: Subject to any disclaimer, the term of this patent is extended or adjusted under 35 U.S.C. 154(b) by 580 days.

(21) Appl. No.: 12/466,377

(22) Filed: May 14, 2009

(65) Prior Publication Data

US 2010/0287722 A1 Nov. 18, 2010

(51) Int. Cl.
*A47L 13/20* (2006.01)

(52) U.S. Cl. ..... 15/119.1; 15/120.1; 15/120.2; 15/228

(58) Field of Classification Search ..... 15/98, 25, 15/119.1, 120.1, 120.2, 229.2, 228; 34/58
See application file for complete search history.

(56) References Cited

U.S. PATENT DOCUMENTS

| | | | | |
|---|---|---|---|---|
| 5,907,883 | A * | 6/1999 | Thomasson | 15/120.2 |
| 6,112,358 | A * | 9/2000 | Specht | 15/120.2 |
| 6,427,280 | B1 * | 8/2002 | Specht | 15/120.2 |
| 7,891,039 | B2 * | 2/2011 | Lin | 15/120.1 |
| 8,011,055 | B2 * | 9/2011 | Lesley | 15/119.1 |
| 2002/0108198 | A1 * | 8/2002 | Specht | 15/120.1 |
| 2003/0084530 | A1 * | 5/2003 | Specht | 15/120.2 |
| 2004/0128783 | A1 * | 7/2004 | Lesley et al. | 15/120.1 |
| 2005/0204495 | A1 * | 9/2005 | Perkitny | 15/119.2 |
| 2006/0021171 | A1 * | 2/2006 | Niccolai | 15/120.1 |
| 2007/0186363 | A1 * | 8/2007 | Chiang | 15/120.1 |
| 2007/0226929 | A1 * | 10/2007 | Kao | 15/120.1 |
| 2008/0010768 | A1 * | 1/2008 | Lesley | 15/120.1 |
| 2009/0025163 | A1 * | 1/2009 | Specht et al. | 15/120.1 |
| 2009/0070950 | A1 * | 3/2009 | Lin | 15/119.1 |
| 2009/0260169 | A1 * | 10/2009 | Chen | 15/120.1 |
| 2009/0307855 | A1 * | 12/2009 | Kao | 15/3 |

* cited by examiner

*Primary Examiner* — Mark Spisich
*Assistant Examiner* — Michael Jennings
(74) *Attorney, Agent, or Firm* — Lin & Associates IP, Inc.

(57) ABSTRACT

A mop includes a spinning device, a shank fixed to a first end of the spinning device, an operation rod having a first end connected to a second end of the spinning device, and a mop head connected to a second end of the operation rod. When a force is applied in a first direction making the operation rod and the spinning device move relatively in an axial direction, the mechanism in the spinning device drives the operation rod and the mop head to spin in the same direction simultaneously so as to generate a centrifugal force to remove the water from the mop head. When the force stops, the spring and the clutch structure in the spinning device make the operation rod back to the original position under a condition that the operation rod does not spin.

9 Claims, 6 Drawing Sheets

MOP WITH SPINNING DEVICE

BACKGROUND OF THE INVENTION

1. Field of the Invention

The present invention generally relates to a mop, and in particular to a mop with a spinning device which spins the mop head to remove water by a centrifugal force from the mop head by axially pushing the shank of the mop.

2. The Prior Arts

A conventional mop generally includes a mop head, multiple fabric strips connected to the mop head where the fabric strips designed to absorb water are usually made of cotton, sponge, and so on. A shank is connected to the mop head so that the user holds the shank and merges the mop head into water and then squeezes the fabric strips so as to mop the floor. However, the process to squeeze the fabric strips is inconvenient and requires a big force which is difficult for some users. Some mops are improved to include a clamping device connected thereto and the mop strips can be clamped before using. It is experienced that the fabric strips are unevenly dried and the clamping device occupies a lot of space.

Recently, a product, "mop bucket with wringer" is provided in the market. The structure of the product generally comes with an outer bucket and an inner bucket with many apertures where the mop can be spun. When the inner bucket is spinning relative to the outer bucket manually or mechanically, the centrifugal force removes the water from the fabric strips.

SUMMARY OF THE INVENTION

A primary objective of the present invention is to provide a mop which has spinning function without using any extra power supply and the mop head is spun by an axially operation of the shank of the mop so as to remove water from the fabric strips by a centrifugal force.

The present invention provides a mop which includes a spinning device, a shank fixedly connected to a first end of the spinning device, an operation rod having a first end movably connected to a second end of the spinning device, and a mop head fixed to a second end of the operation rod. The operation rod and the spinning device can have an axial relative motion. When a force is applied in a first direction making the operation rod and the spinning device move relatively in an axial direction, the mechanism in the spinning device drives the operation rod and the mop head to spin in the same direction simultaneously so as to generate a centrifugal force to remove the water from the mop head. When the force stops, the spring and the clutch unit in the spinning device make the operation rod back to the original position under a condition that the operation rod does not spin.

The spinning device of the present invention includes an outer sleeve and an inner sleeve located within the outer sleeve. A movable member is fixed to the first end of the outer sleeve and positioned within the inner sleeve. The movable member is axially movable relative to the inner sleeve. A spiral hole is defined through the movable member and a spiral rod extends movably through the spiral hole. A connection tube is located at the second end of the inner sleeve. A clutch unit is fixed to the spiral rod and an end member is movably connected to an end of the spiral rod and is rotatable relative to the spiral rod. A clutch structure is located between the end member and the clutch unit, and an operation rod is fixed to the other end of the end member. The end member is fixed to the operation rod. A spring is located in the inner space of the inner sleeve, with two ends contacting the movable member and the inner edge of the inner sleeve. When a force is applied to the operation rod toward the movable member, the clutch structure generates an engagement behavior driving the spiral rod, and the spiral rod is rotated by the guidance of the spiral hole of the movable member. The operation rod and the mop head rotate along with the spiral rod. At the same time, the inner sleeve also moves axially, and compresses the spring for storing an elastic force. The inner sleeve and the operation rod are pushed back to the original positions by the elastic force of the spring when the force is no longer applied to the operation rod. In the process, the spiral rod is still rotated reversibly by the guidance of the spiral hole of the movable member. However, no engagement behavior exists in the clutch structure between the clutch unit and the end member in the reverse moving direction, thus the operation rod does not spin.

In order to prevent a rotation movement of the inner sleeve when moving in the outer sleeve, the present invention provides at least one elongate slot defined through a wall of the inner sleeve. At lease one lip which can be inserted into the elongate slot is positioned on the movable member, for limiting the rotation movement of the inner sleeve when the inner sleeve and the movable member are under a relative movement.

In order to achieve easy assembly and space-saving, the present invention further includes a threaded hole at the first end of the outer sleeve where the outer threads positioned at an end of the shank can be assembled.

In the present invention, a radial hole is positioned through the spiral rod in a radial direction, and a pin is positioned at the radial hole. The clutch unit comprises a first clutch member and a second clutch member, where the second clutch member has a recess. The spiral rod is extended through the first clutch member and the second clutch member, and the first clutch member and the second clutch member are fixed to each other by positioning the pin at the recess, thereby fixing the clutch unit to the spiral rod.

The clutch structure between the clutch unit and the end member according to the present invention includes multiple first wedges at the second clutch member and multiple second wedges at the end member, where the second wedges can only drive the first wedges in one direction.

In order to reduce the friction when the inner sleeve moves in the outer sleeve, the outer sleeve includes multiple ribs extending axially from an inner wall thereof to be contacted with outer periphery of the inner sleeve.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
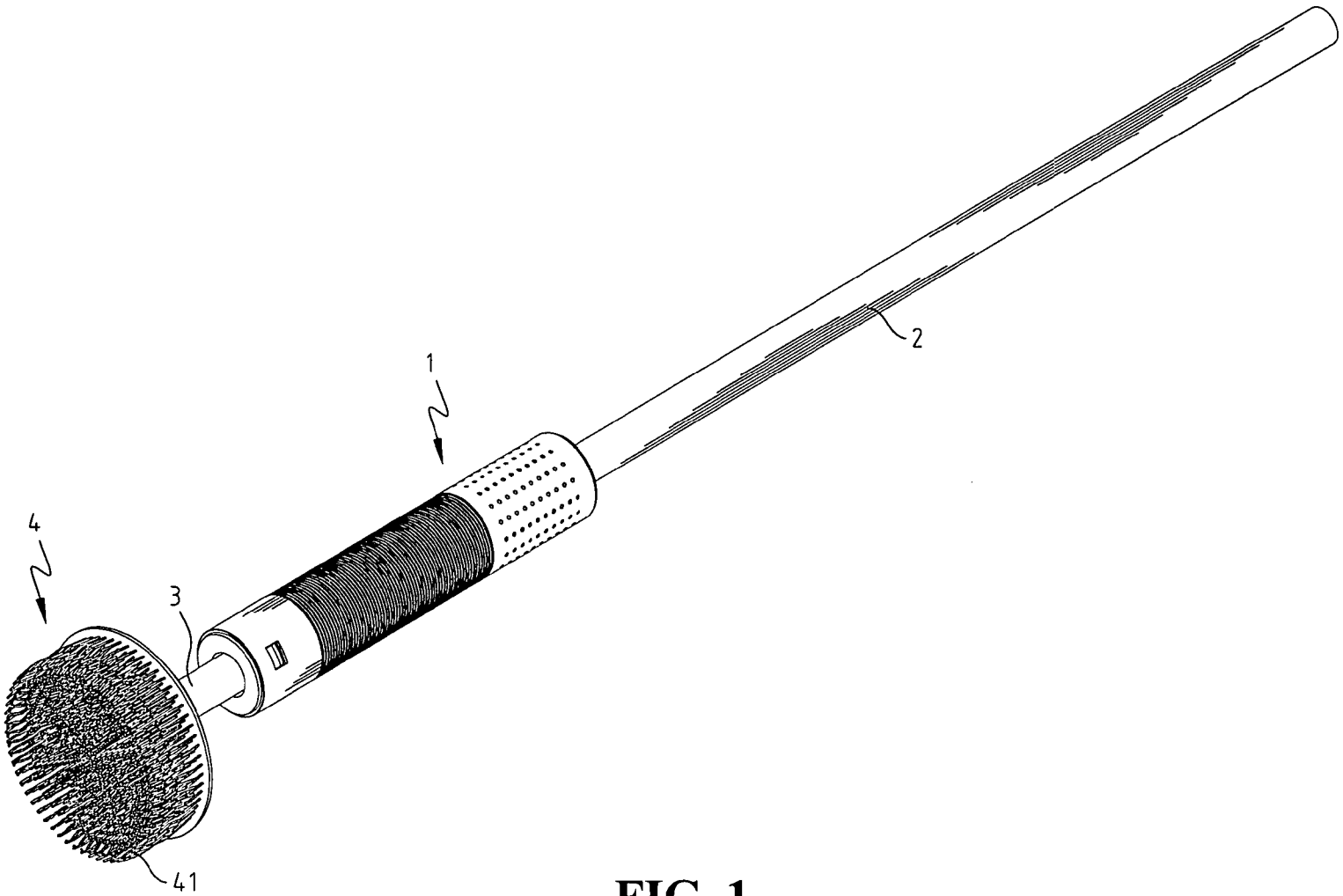
FIG. 1 is a perspective view showing a mop in accordance with the present invention.

With reference to the drawings and in particular to FIG. 1, a mop in accordance with the present invention comprises a spinning device 1 and a shank 2 connected to a first end of the spinning device. An operation rod 3 has a first end connected to a second end of the spinning device 1 and a mop head 4 is connected to a second end of the operation rod 3. The mop head 4 includes multiple mopping members 41 connected thereto. The shank 2 is fixed to the spinning device 1 and the operation rod 3 can spin relative to the spinning device 1. The mop head 4 is connected to the operation rod 3 and spins together with the operation rod 3.

Figure 2:
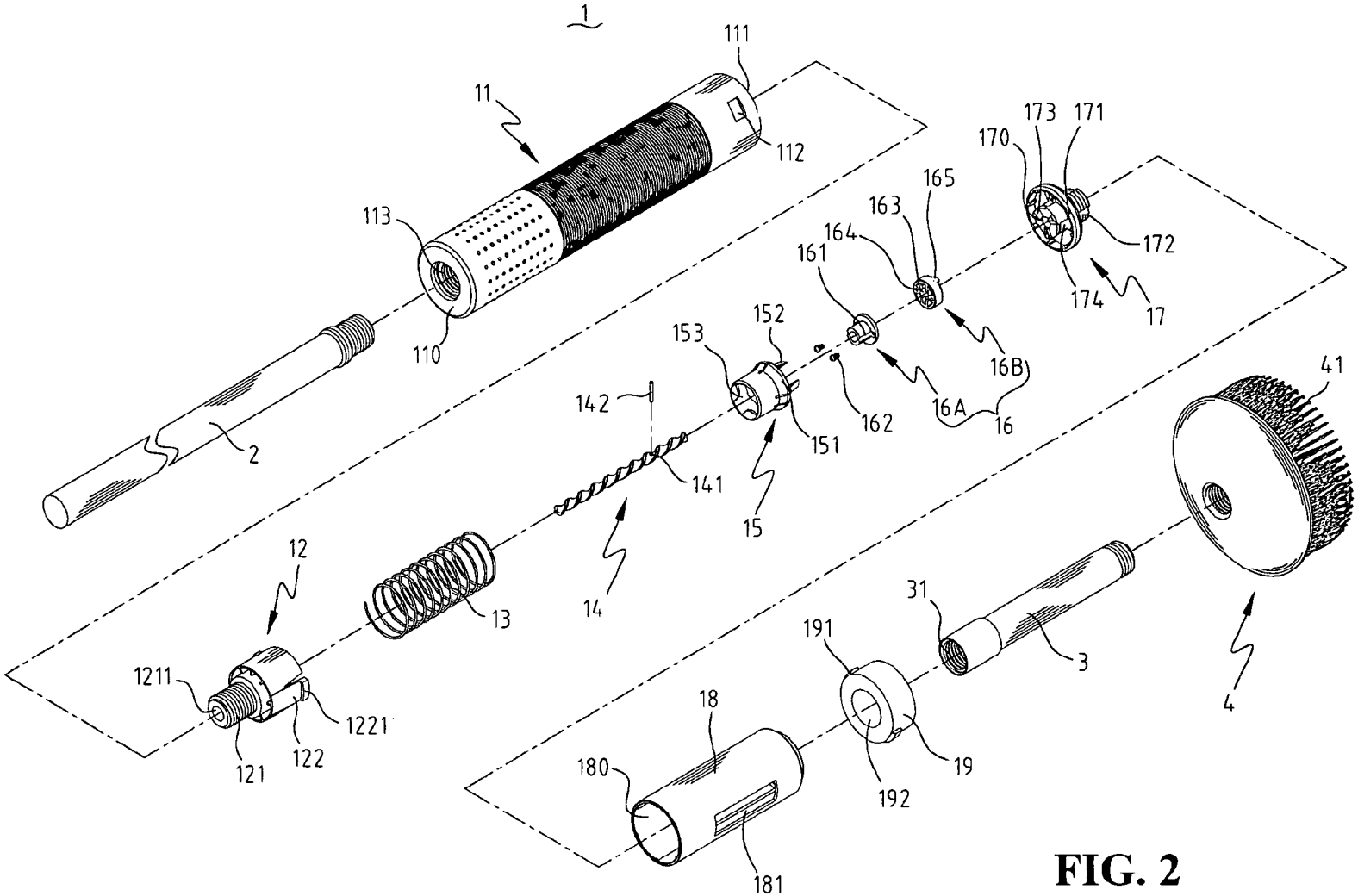
FIG. 2 is an exploded view showing the mop of the present invention.
Figure 2A:
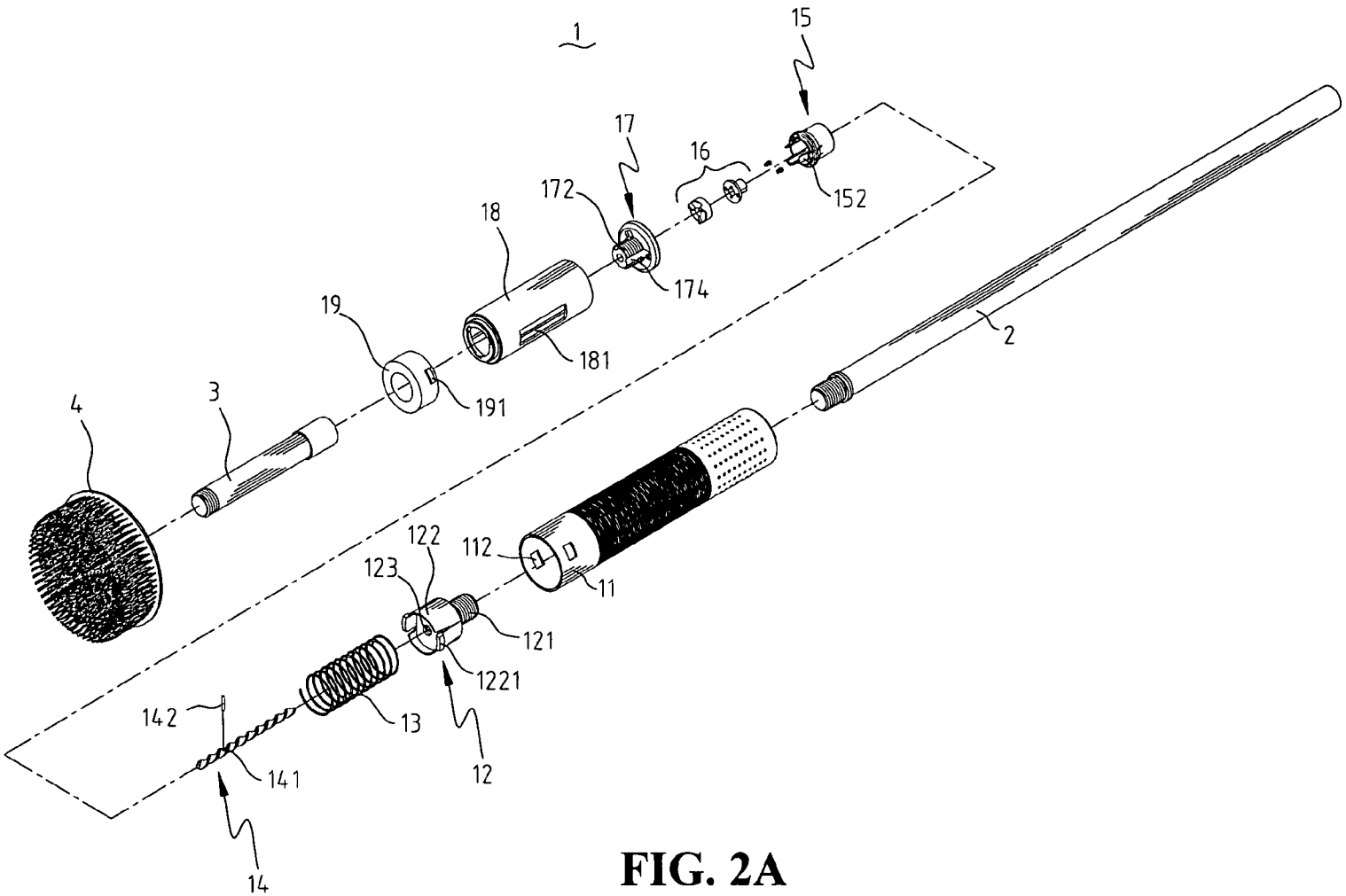
FIG. 2A is an exploded view of the mop of the present invention from another direction.
Figure 3:
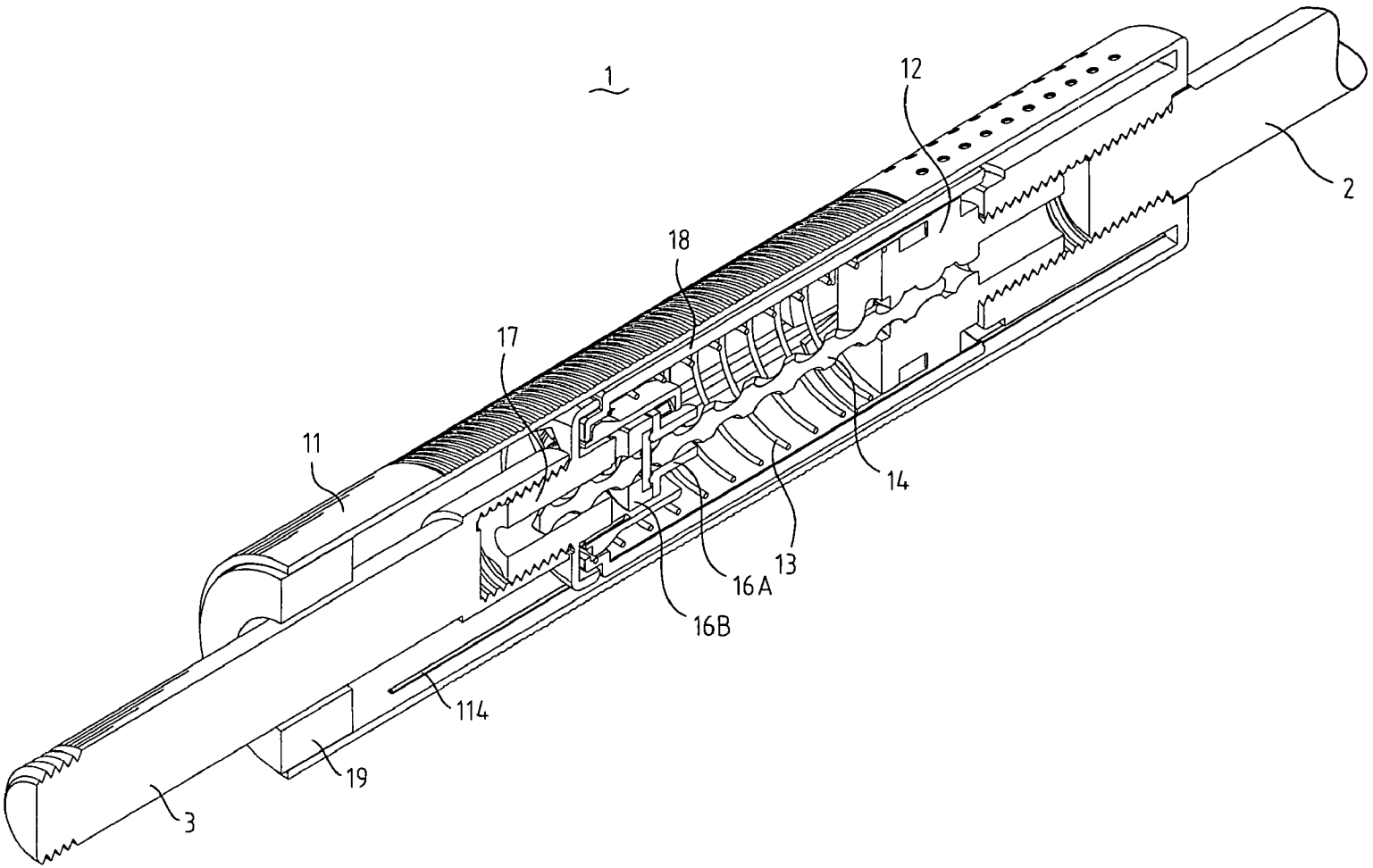
FIG. 3 is a cross sectional view of the spinning device of the mop of the present invention.

FIGS. 2, 2A and 3 show the detailed structure of the spinning device 1, and the spinning device 1 includes an outer sleeve 11, a movable member 12, a spring 13, a spiral rod 14, a connection tube 15, a clutch unit 16, an end member 17, an inner sleeve 18 and an end ring 19.

The outer sleeve 11 is a cylindrical tube which is mounted to the spinning device 1 and includes a skidproof structure such as multiple projections, notches or patterns on the surface so that the user can firmly hold the outer sleeve 11. The outer sleeve 11 includes a hollow interior space and a first end 110 and a second end 111 on opposite sides. A threaded hole 113 is defined in the first end 110 so as to be connected with the shank 2. At least one engaging hole 112 is defined through the wall of the second end 111 of the outer sleeve 11. The second end of the outer sleeve 11 is connected with the operation rod 3. The outer sleeve 11 further includes multiple ribs 114 extending axially in an inner wall thereof.

The inner sleeve 18 extended with a length is located within the hollow interior space of the outer sleeve 11 and has an inner space 180. At least one elongate slot 181 is defined through a wall of the inner sleeve 18 and the outer periphery of the inner sleeve 18 is in contact with the ribs 114 of the outer sleeve 11 so as to reduce the friction when the inner sleeve 18 moves relative to the outer sleeve 11.

The movable member 12 is fixed to the first end 110 of the outer sleeve 11 and located with in the outer sleeve 11 and the inner space 180 of the inner sleeve 18. The movable member 12 includes outer threads 121 at one end thereof and which are connected to the threaded hole 113 of the outer sleeve 11 from an inside of the outer sleeve 11. The other end of the movable member 12 is slidably inserted into the inner sleeve 18. Multiple flexible plates 122 are formed to the outside of movable member 12 and each flexible plate 122 has a lip 1221 on a distal end thereof. A passage 1211 is defined through the movable member 12 and has a spiral hole 123 in the end of the lips 1221 of the movable member 12. The outer threads 121 are connected to the threaded hole 113 of the outer sleeve 11 from an inside of the outer sleeve 11 so that the movable member 12 is fixed in the first end 110 of the outer sleeve 11. The lips 1221 are engaged with the elongate slot 181. The inner sleeve 18 and the movable member 12 can move axially within the range of the length of the elongate slot 181, and prevent the inner sleeve 18 and the movable member 12 from relative rotation.

The spiral rod 14 connects to the spiral hole 123 and has a radial hole 141 through which a pin 142 extends so as to fix the spiral rod 14 to the clutch unit 16.

The clutch unit 16 is fixed to the spiral rod 14 and includes a first clutch member 16A and a second clutch member 16B which has a recess 163 and at least one threaded hole 164. The other end has multiple first wedges 165. The first clutch member 16A has a disk on one end and a tubular portion on the other end connected to the disk. Multiple apertures 161 corresponding to the threaded holes 164 are defined in the first clutch member 16A. The first and second clutch members 16A, 16B are mounted to the spiral rod 14; the pin 142 of the spiral rod 14 is engaged with the recess 163 of the second clutch member 16B. Bolts 162 extend through the apertures 161 of the first clutch member 16A and threadedly connected to the threaded holes 164 of the second clutch member 16B. Thereby, the pin 142 is clamped by the first and second clutch members 16A, 16B so as to fix the clutch unit 16 to the spiral rod 14.

After fixing the clutch unit 16 to the spiral rod 14, the clutch unit 16 and the spiral rod 14 extend into the connection tube 15 including a through hole 153 at a center thereof and multiple flexible walls 151 are located around the through hole 153. The connection tube 15 further includes multiple protrusions 152 extending from an end thereof. After the connection of the connection tube 15 and clutch unit 16, the assembly is further connected to the other end of the inner sleeve 18. And, the spring 13 is located in the inner space 180 of the inner sleeve 18, two ends of the spring 13 are in contact with the movable member 12 and the inner edge of the inner sleeve 18. The end member 17 is connected to the end of the spiral rod 14. The end member 17 has a disk 171 which has a threaded tube 172 on one side thereof whereas the other side has multiple second wedges 173. The second wedges 173 together with the first wedges 165 form a clutch structure which can only be engaged and driven in one direction. Multiple insertion holes 174 are defined axially in the disk 171 peripheral to the end member 17, for inserting the protrusions 152 of the connection tube 15 when connecting the end member 17 and the connection tube 15, so as to prevent relative rotation between the end member 17 and the connection tube 15. The end member 17 has a central hole 170 where an end of the spiral rod 14 is movably inserted.

The operation rod 3 has a threaded hole 31 on one end thereof so as to be connected with the threaded tube 172 of the end member 17. The other end of the operation rod 3 is connected to the mop head 4. Before the connection of the operation rod 3 and the mop head 4, an end ring 19 is first connected to the second end 111 of the outer sleeve 11, then the operation rod 3 is extended through the center hole 192 of the end ring 19 so that the blocks 191 positioned on the outside of the end ring 19 are engaged with the engaging holes 112 of the outer sleeve 11. Therefore the end ring 19 supports the operation rod 3, preventing shaking behavior between operation rod 3 and the outer sleeve 11. However, the operation rod 3 can freely move relative to the center hole 192.

Figure 4:
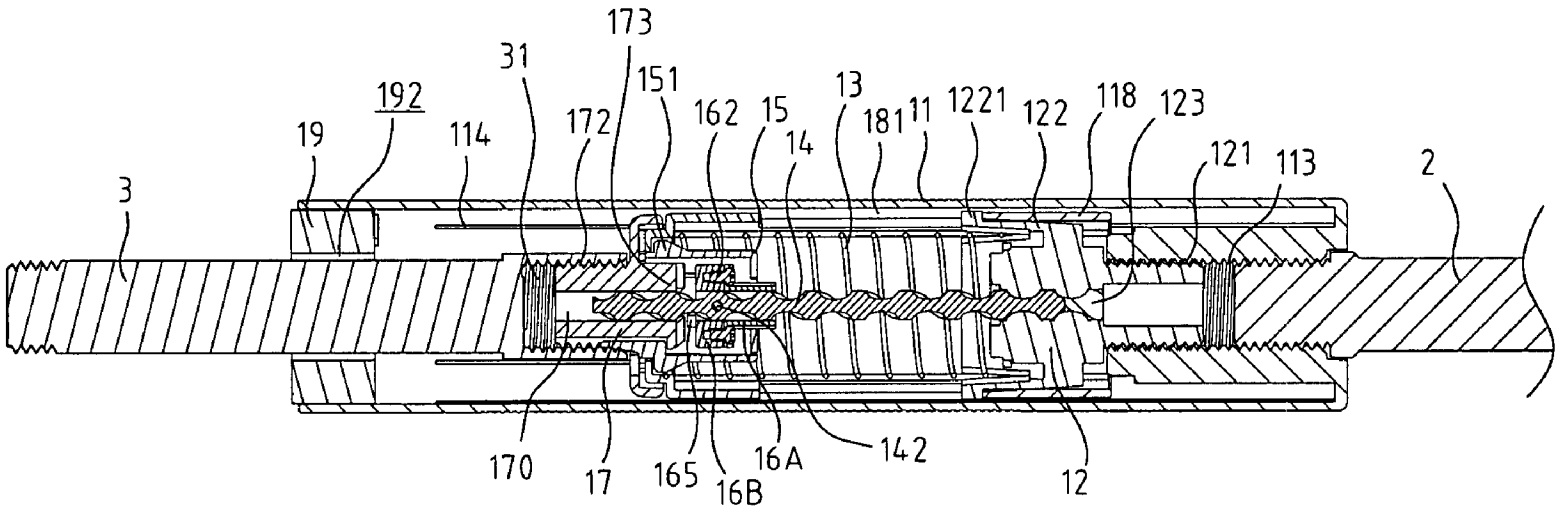
FIG. 4 is a cross sectional view to show the spinning device of the mop of the present invention wherein the spring is not compressed.
Figure 5:
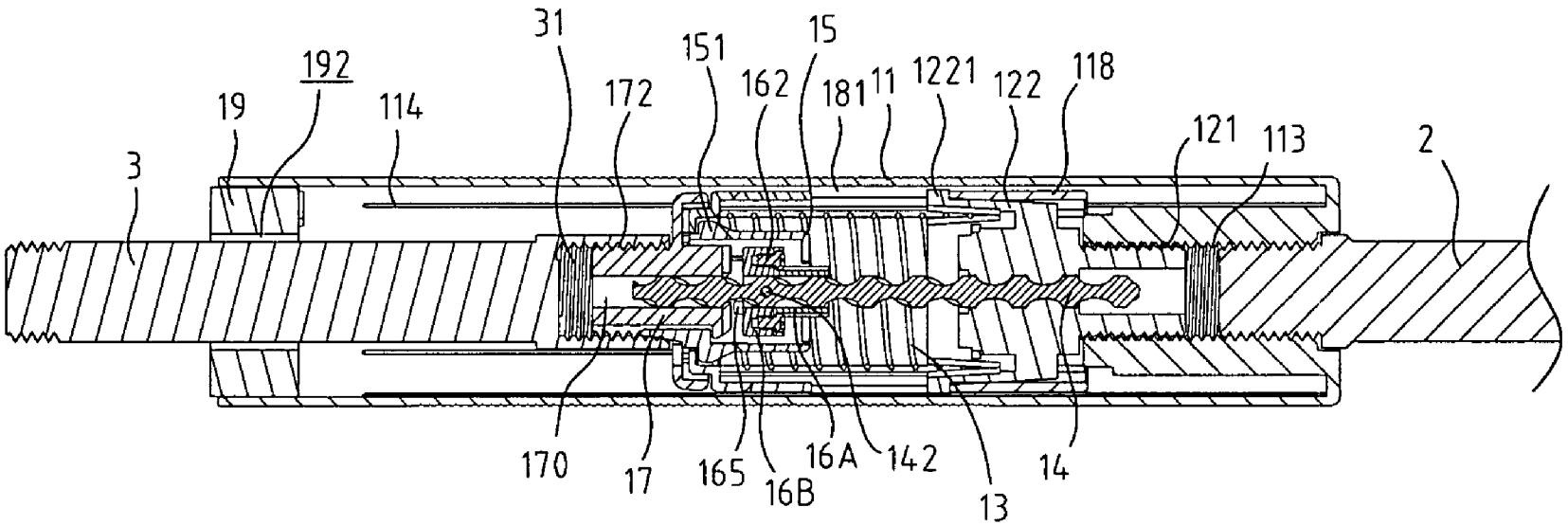
FIG. 5 is a cross sectional view to show the spinning device of the mop of the present invention wherein the spring is compressed.

Preferably, a bucket with a spin inner bucket is used in combination with the mop of the present invention where the bucket with a spin inner bucket is known to the person in the art and will not be described in detail herein. When in use, the mop head 4 together with the mopping members 41 are put in the inner bucket with the shank 2 and the outer sleeve 11 held by the two hands of the user, respectively, for applying an axial force toward the mop head 4. Because the mop head 4 and the operation rod 3 are restricted by the inner bucket, the outer sleeve 11 and the operation rod 3 move relatively in an axial direction so that the operation rod 3 moves into the outer sleeve 11 as shown in FIG. 5. In this process, the inner sleeve 18 is moved simultaneously within the outer sleeve 11 so as to compress the spring 13 to store an elastic force. The end member 17 is also pushed simultaneously whereas the spiral rod 14 is also moved axially at the same time by the engagement of the first wedges 165 and the second wedges 173. The spiral rod 14 is rotated by the guidance of the spiral hole 123 of the movable member 12, so as to rotate the mop head 4 and the operation rod 3 for generating a centrifugal force. The water contained in the mop head 4 is swung to the bucket by the centrifugal force. When the outer sleeve 11 and the shank 2 are released by the user, the inner sleeve 18 and the operation rod 3 are moved in opposite directions back to their original positions as shown in FIG. 4 by the elastic force of the spring 13. In the process, the spiral rod 14 is also rotated reversibly by the guidance of the spiral hole 123 of the movable member 12. However, because the first wedges 165 cannot engage with the second wedges 173 during the process, the operation rod 3 does not spin. By repeatedly operating the processes, the water can be separated from the mop head 4 to make it suitable to mop the floor.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A mop comprising:

a spinning device;

a shank connected to a first end of the spinning device;

an operation rod having a first end connected to a second end of the spinning device; and a mop head fixed to a second end of the operation rod;

wherein the spinning device comprises:

an outer sleeve having a hollow interior space, and a first end and a second end in opposite positions;

an inner sleeve located within the hollow interior space of the outer sleeve and having an inner space extended in an axial direction;

a movable member fixed in the outer sleeve near the first end of the outer sleeve, and located in the inner space of the inner sleeve, the movable member being able to move axially relative to the inner sleeve and having a spiral hole defined thereon;

a spiral rod extended through the spiral hole of the movable member;

a connection tube located in the inner space of a second end of the inner sleeve;

a clutch unit fixed to the spiral rod;

an end member having one end movably connected to an end of the spiral rod to be rotatable relative to the spiral rod, and a clutch structure that faces the clutch unit and can be driven only in one direction, and the other end of the end member fixed to the operation rod; and a spring located in the inner space of the inner sleeve, two ends of the spring being in contact with the movable member and an inner edge of the inner sleeve, respectively; and wherein the spinning device drives the operation rod to spin when the operation rod moves axially relative to the spinning device.

2. The mop as claimed in claim 1, wherein the inner sleeve includes at least one axial elongate slot on a wall thereof and the movable member includes at least one lip to be inserted in the axial elongate slot, for limiting the rotation movement of the inner sleeve when the inner sleeve and the movable member move relative to each other.

3. The mop as claimed in claim 1, wherein the first end of the outer sleeve has a threaded hole and the shank has outer threads on one end thereof for connecting to the threaded hole from outside of the outer sleeve, and the movable member includes outer threads for connecting to the threaded hole of the outer sleeve from inside of the outer sleeve.

4. The mop as claimed in claim 1, wherein the spiral rod has a radial hole through which a pin extends, the clutch unit comprises a first clutch member and a second clutch member, where the second clutch member has a recess, the spiral rod is extended through the first clutch member and the second clutch member, and the first clutch member and the second clutch member are fixed to each other by positioning the pin at the recess, thereby fixing the clutch unit to the spiral rod.

5. The mop as claimed in claim 4, wherein the clutch structure includes multiple first wedges at the second clutch member and multiple second wedges at the end member, and the second wedges drive the first wedges in one direction.

6. The mop as claimed in claim 1, wherein the end member has a threaded tube extending therefrom and the operation rod has a threaded hole to be connected to the threaded tube.

7. The mop as claimed in claim 1, wherein the second end of the outer sleeve has an end ring including a center hole through which the operation rod extends.

8. The mop as claimed in claim 1, wherein the outer sleeve includes multiple ribs extending axially from an inner wall thereof to be contacted with outer periphery of the inner sleeve.

9. The mop as claimed in claim 1, wherein the connection tube has multiple protrusions extending from an end thereof and multiple insertion holes are defined axially in the end member for inserting the protrusions.

* * * * *